US007535331B2

(12) United States Patent
Sakai et al.

(10) Patent No.: US 7,535,331 B2
(45) Date of Patent: May 19, 2009

(54) BOOSTER TRANSFORMER FOR DRIVING MAGNETRON AND TRANSFORMER UNIT HAVING THE BOOSTER TRANSFORMER

(75) Inventors: Shinichi Sakai, Nara (JP); Keiichi Satou, Daito (JP); Kenji Yasui, Yamatokoriyama (JP); Haruo Suenaga, Katano (JP); Hisahi Morikawa, Kitakatsuragi-gun (JP)

(73) Assignee: Panasonic Corporation, Osaka (JP)

( * ) Notice: Subject to any disclaimer, the term of this patent is extended or adjusted under 35 U.S.C. 154(b) by 652 days.

(21) Appl. No.: 10/551,729

(22) PCT Filed: Apr. 14, 2004

(86) PCT No.: PCT/JP2004/005327

§ 371 (c)(1),
(2), (4) Date: Oct. 3, 2005

(87) PCT Pub. No.: WO2004/093104

PCT Pub. Date: Oct. 28, 2004

(65) Prior Publication Data

US 2007/0103952 A1 May 10, 2007

(30) Foreign Application Priority Data

Apr. 15, 2003 (JP) ..... 2003-110391

(51) Int. Cl.
*H01F 27/30* (2006.01)

(52) U.S. Cl. ..... 336/208

(58) Field of Classification Search ..... 336/208, 336/198, 192, 65, 83, 200, 180–186
See application file for complete search history.

(56) References Cited

U.S. PATENT DOCUMENTS 6,449,178 B1 9/2002 Sakai et al.

FOREIGN PATENT DOCUMENTS

| | | |
|---|---|---|
| EP | 0 364 171 | 4/1990 |
| EP | 1 058 279 | 12/2000 |
| JP | 5-66943 | 9/1993 |
| JP | 6-244035 | 9/1994 |
| JP | 7-161462 | 6/1995 |
| JP | 10-27720 | 1/1998 |
| JP | 2001-52935 | 2/2001 |

*Primary Examiner*—Tuyen T. Nguyen
(74) *Attorney, Agent, or Firm*—Pearne & Gordon LLP

(57) ABSTRACT

A booster transformer 100 for driving a magnetron includes a bobbin 11 on which at least a first winding 13 and a secondary winding 15 are wound and a core 19 inserted through the center of the bobbin 11, wherein a winding area of the secondary winding 15 is divided into two areas while interposing a partition wall 23, and an outer diameter d of a wire material of the secondary winding 15 and a width t1 of each of the divided winding areas are so set as to satisfy the relation t1<11*d*.

4 Claims, 9 Drawing Sheets

$0.8t_2 < t_1 < 11d$

BOOSTER TRANSFORMER FOR DRIVING MAGNETRON AND TRANSFORMER UNIT HAVING THE BOOSTER TRANSFORMER

TECHNICAL FIELD

This invention relates to a booster transformer for driving a magnetron and a transformer unit having the booster transformer. The invention particularly relates to a technology for reducing the size of the booster transformer.

BACKGROUND ART

An inverter system radio frequency heating apparatus, for example, has a built-in transformer unit having a booster transformer packaged onto a substrate. A circuit of this transformer unit will be explained with reference to FIG. 9.

A commercial power source 51 is subjected to full wave rectification by a rectifier circuit 53 such as a diode bridge, is converted to a high frequency voltage by an inverter 55 and is then applied to a primary winding 59 of a booster transformer 57. Consequently, a high frequency high voltage of several kilo-volts develops in a secondary winding 61 of the booster transformer 57.

This high frequency high voltage is rectified by a voltage doubler rectifier circuit 67 including a capacitor 63 and a diode 65. Consequently, a high voltage is applied to a magnetron 69 as a microwave generator. A heater winding 71 of the booster transformer 57 is connected to a filament 73 of the magnetron 69 to heat the filament 73. The magnetron 69 oscillates the microwave by means of heating of the filament 73 and the application of the high voltage.

One of the booster transformers 57 for driving the magnetron has a construction in which the primary winding 59, the secondary winding 61 and the heater winding 71 are wound on one bobbin 75 as shown in FIG. 10, for example, and are juxtaposed on the same axis as those of U-shaped magnetic bodies 77 and 78. In such a booster transformer 57, a pin terminal connected to each winding is fitted and fixed into each terminal hole of the substrate on which the booster transformer 57 is to be packaged.

The booster transformer for driving the magnetron, having the construction described above is described in Japanese publication JP-A-10-27720, for example.

In the booster transformer for driving the magnetron of this kind, reduction of the size of apparatuses such as a heating cooking machine and mounting of components providing higher addition values with higher function of the apparatus have been required, and down-sizing of each part of the apparatus has been positively attempted. Among them, the boosting transformer is a component having particularly a large weight and a large capacity and reduction of its size has been required, in particular.

A bobbin 75 on which a primary winding 59 and a secondary winding 61 of the booster transformer are wound is produced by molding. When the shape of the bobbin 75 becomes complicated, a mold for molding becomes expensive and the cost of production increases. Particularly because the secondary winding 61 is formed into a plurality of layers such as three or more layers in some cases, the shape of the bobbin 75 gets complicated. When ribs 79 for dividing the winding area are simply omitted or the number of layers is decreased so as to simplify the shape of the bobbin, a line voltage increases to thereby induce corona discharge and service life of the transformer is drastically shortened.

DISCLOSURE OF INVENTION

In view of the problems described above, the invention aims at providing a booster transformer for driving a magnetron that can reduce a size and an occupying space in a packaging substrate and can render a transformer unit compact without sacrificing transformer performance and moreover without inviting the increase of a winding time, and a transformer equipped with the booster transformer.

The object described above can be accomplished by the following construction.

(1) A booster transformer for driving a magnetron, including at least a bobbin having a primary winding and a secondary winding wound thereon and a core inserted into a center of the bobbin, wherein a winding area of the secondary winding is divided into two areas while interposing a partition wall, and an outer diameter d of a wire material of the secondary winding and a width $t_1$ of each of the divided wiring areas are so set as to satisfy the relation $t_1 < 11d$.

According to this booster transformer for driving a magnetron, the winding area of the secondary winding is divided into two areas while interposing the partition wall between them. Because the outer diameter d of the secondary winding and the width $t_1$ of each of the divided wiring areas are so set as to satisfy the relation $t_1 < 11d$, it is possible to prevent the occurrence of corona discharge, to improve durability and to render the overall size of the booster transformer compact.

(2) A booster transformer for driving a magnetron as described in (1), wherein the secondary winding is wound on the bobbin while a wire material thereof is arranged under an irregular state.

According to this booster transformer for driving a magnetron, even when the wire material is wound on the bobbin under the irregular state, a maximum potential difference between the most adjacent wires is below a corona discharge occurrence voltage. Therefore, the wire material can be wound on the bobbin by use of a high-speed winding machine providing a relatively rough winding and the production cost can be restricted while preventing the occurrence of corona discharge.

(3) A booster transformer for driving a magnetron as described in (1) or (2), wherein a thickness $t_2$ of the partition wall and the width $t_1$ of each of the divided wiring areas are so set as to satisfy the relation $0.8t_2 < t_1$.

According to this booster transformer for driving a magnetron, it is possible to prevent the increase of the occupying area on a substrate to which the booster transformer is packaged and the increase of an installation space resulting from the increase of an installation height of the booster transformer as the outermost diameter of the secondary winding becomes great and the shape of the booster transformer becomes flat.

(4) A booster transformer for driving a magnetron as described in any of (1) through (3), wherein the wire material of the secondary winding is a solid wire having an insulating coating formed around a core wire or a litz wire formed by merely twisting a plurality of solid wires.

According to this booster transformer for driving a magnetron, durability does not drop even when the withstand voltage of the wire material itself is low because a withstand voltage design having a sufficient margin is made for the bobbin shape. Therefore, an economical construction using an economical solid wire or litz wire can be accomplished.

(5) A booster transformer for driving a magnetron as described in any of (1) through (4), wherein high-voltage components constituting a voltage doubler rectifier circuit for rectifying a high frequency high voltage from the secondary winding of the booster transformer are held integrally with the bobbin.

According to this transformer, the width $L_1$ of the transformer unit, its height $L_2$ and its depth $L_3$ can be reduced, respectively, and the transformer unit can be shaped into a substantially cubic shape. Accordingly, when the transformer unit is packaged onto the substrate, the occupying area on the substrate can be reduced and the substrate can be made small. Since the height can be reduced, too, the capacity necessary for mounting the substrate into the apparatus such as a heating cooking machine can be drastically reduced.

BEST MODE FOR CARRYING OUT THE INVENTION

A booster transformer for driving a magnetron and a transformer unit having the booster transformer according to a preferred embodiment of the invention will be hereinafter explained in detail with reference to the accompanying drawings.

Figure 1:
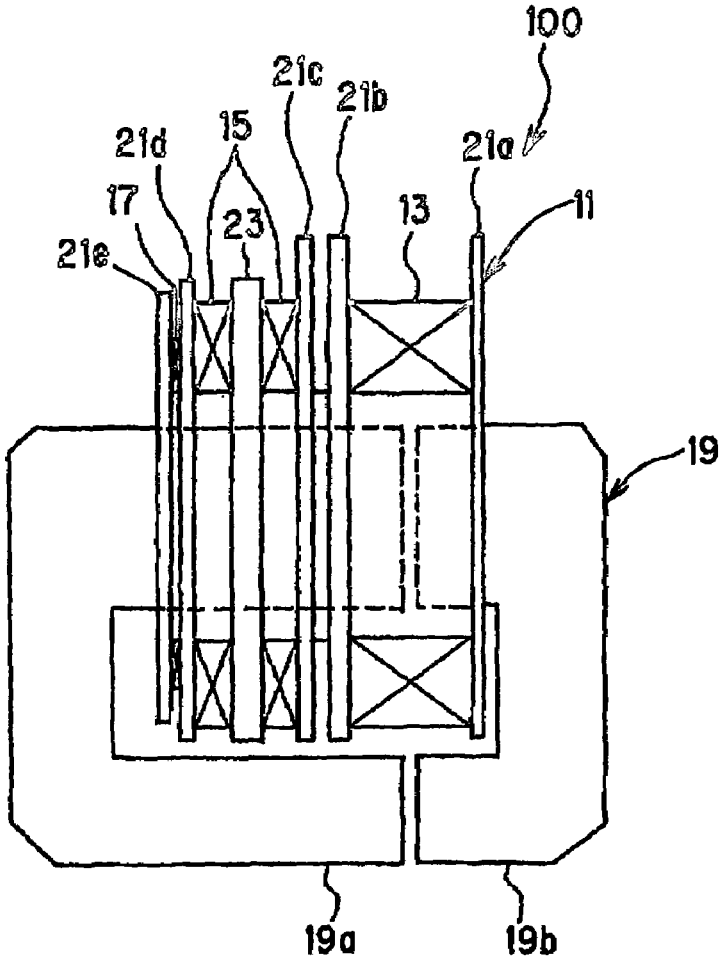
FIG. 1 is a structural view of a booster transformer according to the invention.
Figure 2:
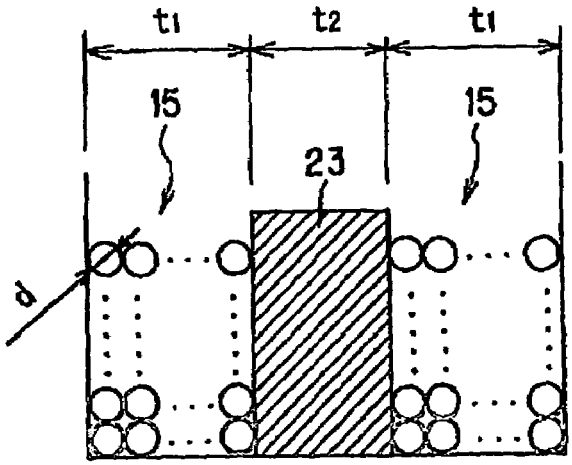
FIG. 2 is a conceptual view of a secondary winding portion of the booster transformer shown in FIG. 1.

FIG. 1 is a schematic structural view of the booster transformer according to the invention and FIG. 2 is a conceptual view of a secondary winding portion of the booster transformer shown in FIG. 2.

As shown in FIG. 1, the booster transformer 100 of the invention mainly includes a bobbin 11 formed of an insulating resin material, a primary winding 13, a secondary winding 15 and a heater winding 17 that are wound on the bobbin 11 and a magnetic body (core) 19 formed of a ferrite core, for example.

The magnetic body 19 is arranged under a state where one of the ends of each of two U-shaped cores 19*a* and 19*b* is inserted into the center of the bobbin 11 and the cores 19*a* and 19*b* oppose each other.

In the bobbin 11, the primary winding 13, the secondary winding 15 and the heater winding 17 are juxtaposed from one of the end sides in the order named on a concentric axis. The primary winding 13 is wound between ribs 21*a* and 21*b* of the bobbin 11. The secondary winding 15 is wound between ribs 21*c* and 21*d* and the heater winding 17, between 21*d* and 21*e*. A partition wall 23 partitions a winding area of the secondary winding 15 into a two-layered structure between the ribs 21*c* and 21*d*.

In the booster transformer 100 according to the invention, the partition wall 23 partitions the winding area of the secondary winding 15 into the two-layered structure as shown in FIG. 2. Each size is set in such a fashion as to satisfy the following formula (1) where d is a wire diameter of a wire material of the secondary winding 15, $t_1$ is a width of each winding area of the secondary winding and $t_2$ is a thickness of the partition wall 23:

$$0.8t_2<t_1<11d \quad (1)$$

When the booster transformer 100 is so designed as to satisfy the range described above, it is possible to prevent the occurrence of corona discharge, to improve durability and to render the overall size of the booster transformer 100 compact.

Next, the reasons for limitation of the range described above will be explained in detail.

The booster transformer used for driving the magnetron applies a line voltage of 2 to 3 kV of the secondary winding and a driving voltage of 4 to 5 kV to the magnetron connected to the output side of a voltage doubler circuit. In a booster transformer used for an inverter of a microwave oven, the primary winding is set to about 15 to about 20 turns and the secondary winding, to about 250 to 350 turns.

Important factors that must be taken into account when designing booster transformers are (1) to secure a line withstand voltage between adjacent windings and (2) to secure an inter-layer withstand voltage when a winding area is constituted into a multi-layered structure by disposing a partition wall. To secure the line withstand voltage of the requirement (1), it is important to avoid the occurrence of corona discharge (partial discharge) in addition, of course, to the improvement of the withstand voltage of the wire material itself.

Figure 3:
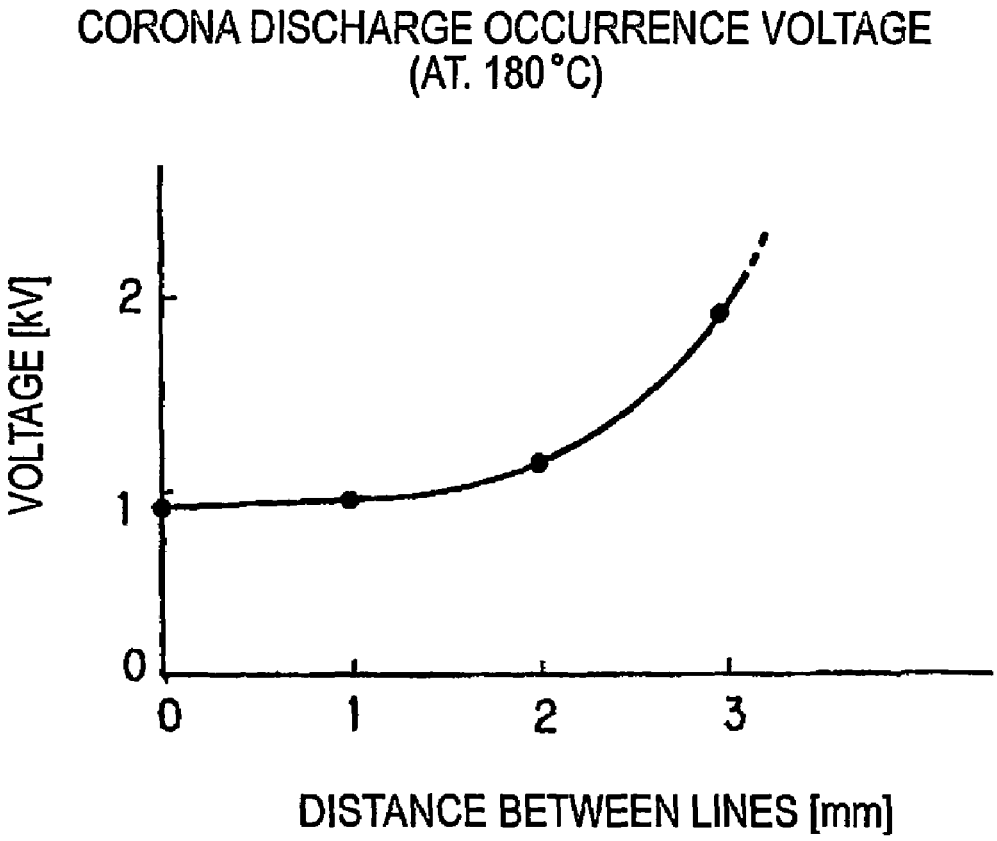
FIG. 3 is a graph showing a calculation result of a voltage at which corona discharge occurs with respect to a line distance.

FIG. 3 shows a calculation result of a voltage at which corona discharge occurs with respect to a line distance. Incidentally, an ambient temperature is set to 180° C.

When the line distance as the distance between the adjacent wire materials is 0, that is, when the wire materials keep touch with each other, corona discharge occurs when a potential difference reaches about 800 V and damages an insulating coating layer of the wire materials. When such corona discharge occurs repeatedly, damages are built up and finally, dielectric breakdown between the wires invites the occurrence of a leakage current with the result that the booster transformer can no longer keep its performance.

The corona discharge occurrence voltage is 930 V when the line distance is 1 mm, is 1, 100 V when the line distance is 2 mm and is 1,900 V when the line distance is 3 mm. The withstand voltage increases with the increase of the line distance. In other words, the smaller the line distance, the lower becomes the corona discharge occurrence voltage and more likely becomes corona discharge to occur.

Figure 4:
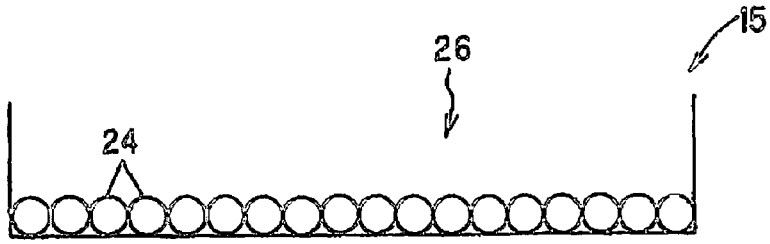
FIGS. 4(*a*) to 4(*c*) are explanatory views for comparing a withstand voltage performance when a winding area of a secondary winding has a single-layered structure and a multi-layered structure, specifically FIG. 4(*a*) shows the single-layered structure, FIG. 4(*b*) shows a two-layered structure, FIG. 4(*c*) shows a three-layered structure having partition walls disposed at two positions and FIG. 4(*d*) shows a four-layered structure having partition walls disposed at three positions.
Figure 4:
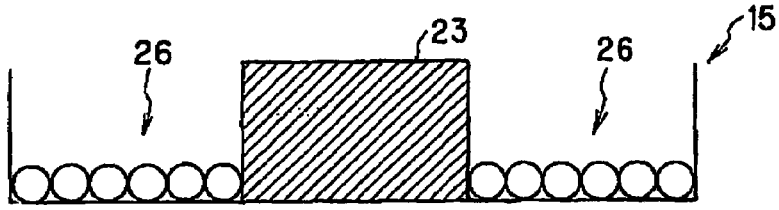
Figure 4:
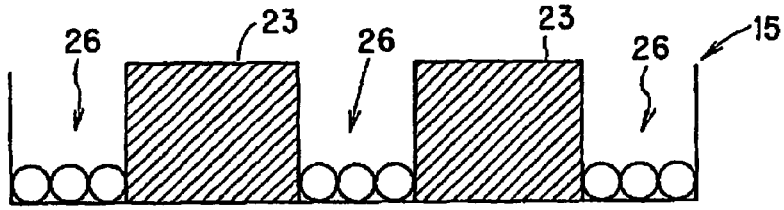
Figure 4:
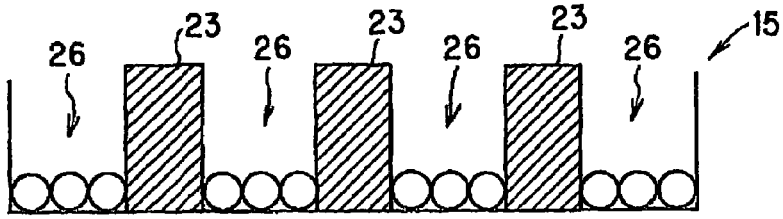

Therefore, the withstand voltages when the winding areas of the secondary winding have a single layer structure and a multi-layered structure will be compared as shown in FIG. 4.

Figure 5:
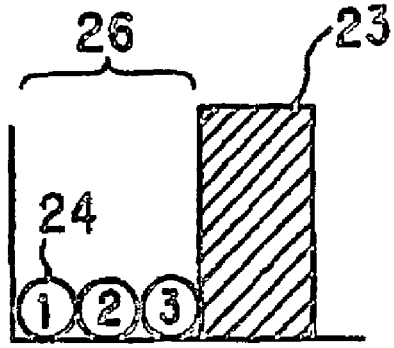
FIGS. 5(*a*) to 5(*d*) are explanatory views assuming the case where a potential difference between adjacent wires becomes maximal, specifically FIG. 4(*a*) to 4(*c*) show a winding sequence and FIG. 4(*d*) shows a state of winding where the maximum potential difference occurs.
Figure 5:
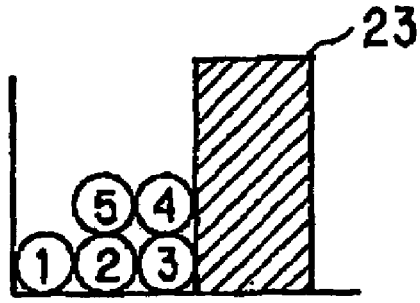
Figure 5:
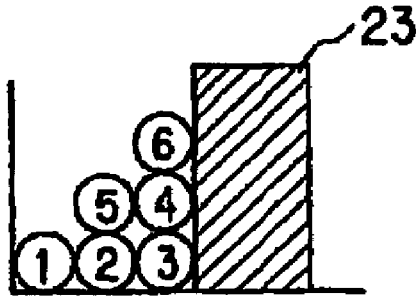
Figure 5:
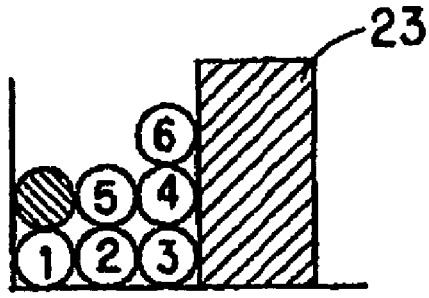

In FIG. 4, (a) represents a single-layered structure, (b) represents a two-layered structure in which the partition wall 23 is disposed at one position, (c) represents a three-layered structure in which the partition walls 23 are disposed at two positions and (d) represents a four-layered structure in which the partition walls 23 are disposed at three positions. FIG. 5 shows the case where the potential difference between the adjacent wires reaches maximum in the structure of (c) by way of example. In other words, when the wire material 24 is serially wound on the winding area as shown in FIG. 5(*a*), the first stage is filled at three turns due to the relation between the width of the winding area 26 and the outer diameter of the wire material 24. The fourth turn is wound immediately above the wire material of the third turn and the fifth turn, immediately above the wire material of the second turn.

The worst assumable case is the case where the wire material of the sixth turn is wound immediately on the wire material of the fourth turn into a triangular shape in a non-uniform winding pattern. When the next seventh pattern is wound in this non-uniform winding pattern, winding becomes unstable immediately on the sixth turn and the fifth turn, and winding can be made stably when the wire material is wound immediately on the wire material of the first turn. Therefore, the first turn and the seventh turn have the relation of the adjacent wire materials having the maximum potential difference.

Assuming that the secondary winding has 300 turns in total and the impressed voltage is 3 kV, the potential difference between the wire materials of the first and seventh turns is calculated in the following way.

Since the secondary winding 15 has the three-layered structure in the structure shown in FIG. 5(*c*), the number of turns per layer is about 100 turns. The impressed voltage per layer is 1 kV. Therefore, the potential difference per turn is about 10 V and the potential difference of six turns between the first and seventh turns is about 60 V.

Therefore, the potential difference is by far smaller than the corona discharge generation voltage of 800 V when the line distance is 0 according to the graph of the corona discharge generation voltage shown in FIG. 3 and even in the case where the maximum potential difference occurs under the state shown in FIG. 5(*d*), the problem of corona discharge between the adjacent wires can be eliminated.

When the maximum potential difference for other structural views 4(*a*), (*b*) and (*d*) is similarly determined, the maximum potential difference is 1.71 kV in the single-layered structure (a), 210 V in the two-layered structure (b) and 60 V in the four-layered structure (d).

The line voltage occurring for each stage inside the layer is given by n(n+1)/2 with n representing the number of turns aligned in the layer. As described above, the number of turns of the secondary winding 15 is from 250 to 350 turns and the impressed voltage is 2 to 3 kV. Therefore, the number of turns is 250 turns and the impressed voltage is 3 kV in the worst case. To keep the line voltage below 800 V in this case, the winding of not greater than 11 turns is necessary in the lowermost stage.

Next, the explanation will be given on the case where the wiring area is converted to the multi-layered structure by disposing the partition wall 23 to secure the withstand voltage between the layers.

The explanation will be given also on the three-layered structure shown in FIG. 4(*c*) by way of example and FIG. 6 conceptually shows the mode in which winding is conducted while interposing the partition wall.

Figure 6:
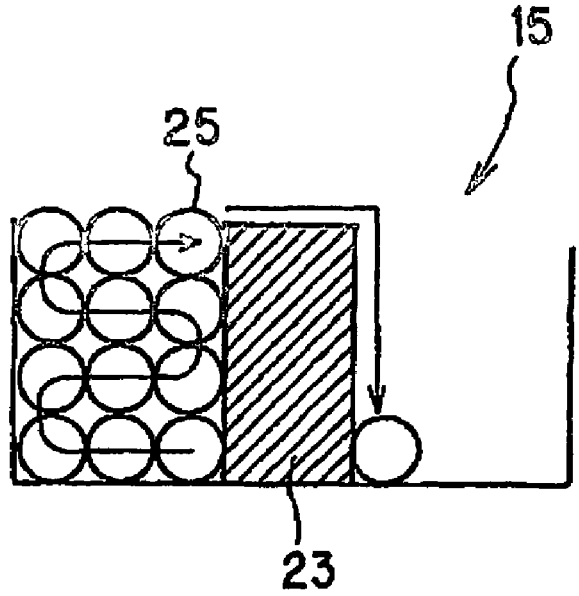
FIGS. 6(*a*) and 6(*b*) are explanatory views showing conceptually a state of winding while interposing a partition wall, specifically FIG. 6(*a*) shows a state where winding is completed in one of the winding areas and winding is started in an adjacent winding area and FIG. 6(*b*) shows a state where a wire material at a final turn position is arranged close to the wire material at the final turn position of the previous winding area.
Figure 6:
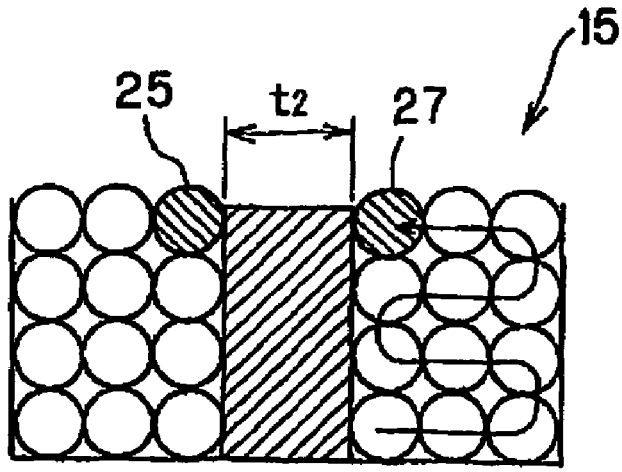

As shown in FIG. 6(*a*), when winding of one winding area is completed, the wire material 25 at the final turn position passes through the slit disposed in the partition wall 23 and winding is started in the adjacent winding area. Winding is serially conducted in the adjacent winding area, too, and the wire material 27 at the final turn position is arranged in some cases close to the wire material 25 of the previous final turn position. When the wire materials 25 and 27 creating the maximum potential difference are arranged close to each other in this way, the proximity distance is the thickness $t_1$ of the partition wall 23 at the shortest.

The potential difference occurring while interposing the partition wall 23 in the case describe above can be calculated in the following way in the three-layered structure. The winding of about 100 turns exists per layer as described above. Since the wire materials are arranged in three rows inside each winding area, the structure becomes 34-stage structure in practice in which about 34 turns are stacked in the radial direction (in the longitudinal direction in the drawing) unlike the state (four-layered structure) shown in FIG. 6. Therefore, the wire materials 25 and 27 creating the maximum potential difference have a potential difference of about 100 turns and a potential difference of about 1 kV occurs.

When the maximum potential difference interposing the partition wall is calculated in the same way for the structures shown in FIGS. 4(*b*) and 4(*d*), the maximum potential difference is 1.5 kV in the two-layered structure (b) and 750 V in the four-layered structure (d).

Table 1 tabulates altogether the results described above.

TABLE 1

| | wiring area width [mm] | partition wall thickness [mm] | maximum potential difference between adjacent wires [V] | maximum potential difference interposing partition wall [V] |
|---|---|---|---|---|
| single-layered structure | 9.0 | — | 1,710 | — |
| two-layered structure | 3.0 * 2 | 3.0 | 210 | 1,500 |
| three-layered structure | 1.67 * 3 | 2.0 | 60 | 1,000 |

TABLE 1-continued

| | wiring area width [mm] | partition wall thickness [mm] | maximum potential difference between adjacent wires [V] | maximum potential difference interposing partition wall [V] |
|---|---|---|---|---|
| four-layered structure | 1.5 * 4 | 1.0 | 60 | 750 |

Referring to Table 1, in the case of the single-layered structure, the maximum potential difference between adjacent wires greatly exceeds the corona discharge occurrence voltage at the line distance of 0. Therefore, regular winding of the wire is essentially necessary for preventing corona discharge.

In the case of the multi-layered structures of more than two layers, the maximum potential difference between the adjacent wires is below the corona discharge occurrence voltage. Therefore, even when the wire material is wound on the bobbin 11 under the irregular state (random winding state where the winding position of the wire material is not positioned adjacent to the position of the previous turn) by using a high-speed winding machine that finishes winding to a relatively rough winding state, the occurrence of corona discharge can be prevented and the increase of the cost of production can be limited.

Since the thickness of the partition wall is set to 3 mm in the case of the two-layered structure, corona discharge does not occur even when the maximum potential difference interposing the partition wall 23 of 1.5 kV exists. The maximum potential difference reaches 1 kV in the case of the three-layered structure but because the thickness of the partition wall 23 is 2.0 mm, corona discharge can be prevented. The maximum potential difference reaches 750 V in the case of the four-layered structure but corona discharge can be prevented, too, because the thickness of the partition wall 23 is 1 mm.

On the other hand, the shape of the bobbin on which the secondary winding 15 is wound is simple and the bobbin can be produced at a low cost in the case of the single-layered structure. The bobbin shape in the multi-layered structure becomes more complicated with the increase of the number of layers, and problems are likely to occur substantially in process ability in 4 or more layers and the production cost is likely to drastically increase.

It becomes necessary from the explanation given above that the number of layers of the secondary winding 15 be at least two that can be produced by high-speed machine winding but be three layers having high process ability of the bobbin. Here, when the two-layered structure is compared with the three-layered structure, the two-layered structure has the merit that the size can be much more reduced when the reduction of the size of the transformer unit is taken into consideration.

It is preferred from the explanation given above that the number of layers of the secondary winding 15 be set to two layers.

When the number of layers of the secondary winding 15 is set to the two layers, the outer diameter d of the wire material of the secondary winding 15 and the width $t_1$ of the winding area are set to the relation that can prevent the occurrence of corona discharge. More concretely, they are set so as to satisfy the following relation (2):

$$t_1<11d \quad (2)$$

When the outermost diameter of the secondary winding 15 becomes great, the booster transformer becomes flat in shape, thereby inviting the increase of the installation space such as the increase of the occupying area of a substrate for packaging the booster transformer and the increase of the installation height of the booster transformer. When the number of the secondary winding is 300 turns, for example, the wire material must be wound 150 turns per layer. When the wire material is wound in five rows in the lowermost stage, the wire material must be wound 30 turns in the radial direction. Assuming that the thickness of the partition wall is 3 mm suitable for the two-layered structure and the outer diameter of the wire material of the secondary winding 15 is 0.5 mm, (30×0.5):(5×0.5×2+3)=(15:8) or approximately 2:1. When the core and the thickness of the insulating layer between the core and the secondary winding in the radial direction are taken into account, too, it is not preferred to further increase the size in the radial direction. Therefore, the thickness $t_2$ Of the partition wall 23 of the secondary winding 15 and the winding area $t_1$ are so set as to satisfy the following relation (3)

$$0.8t_2<t_1 \quad (3)$$

When the relations (2) and (3) are put together, the relation (1) described above can be acquired. When the sizes $t_1$, $t_2$ and d are set in such a fashion as to satisfy the relation (1), it is possible to prevent the occurrence of corona discharge and to render the overall size of the booster transformer 100 compact.

When the transformer unit is constituted by integrally holding the bobbin 11 with high-voltage components constituting a voltage doubler rectifier circuit for rectifying a high frequency high voltage from the secondary winding 15 in the booster transformer 100 satisfying the relation (1), the size of the power source unit using this transformer unit can be drastically reduced.

Figure 7:
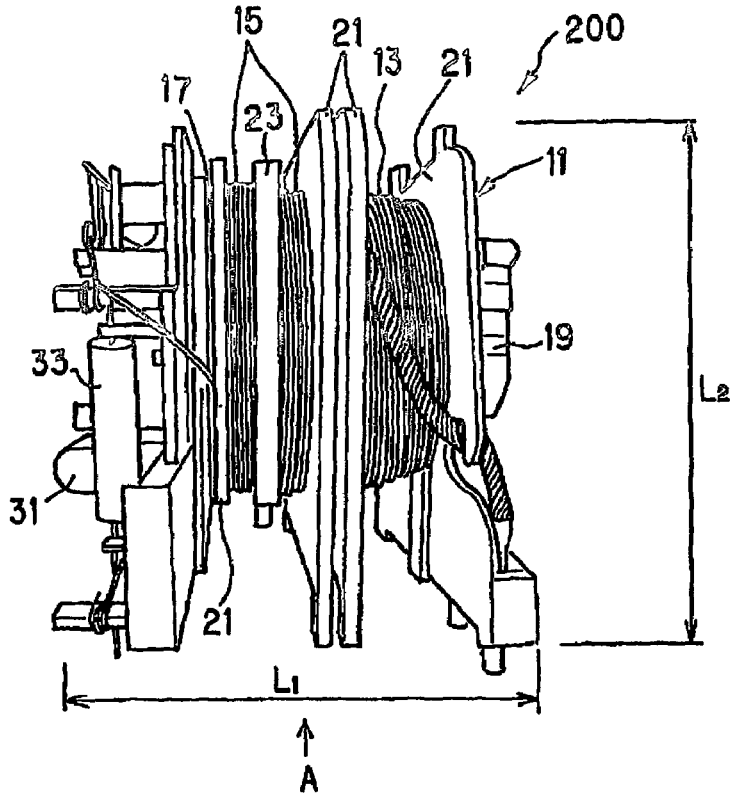
FIGS. 7(*a*) and 7(*b*) are appearance views showing a structural example of a transformer unit, specifically FIG. 7(*a*) is a side view when a substrate packaging surface is positioned at a lower part and FIG. 7 (*b*) is a view taken along an A direction indicated by an arrow shown in FIG. 7(*a*).
Figure 7:
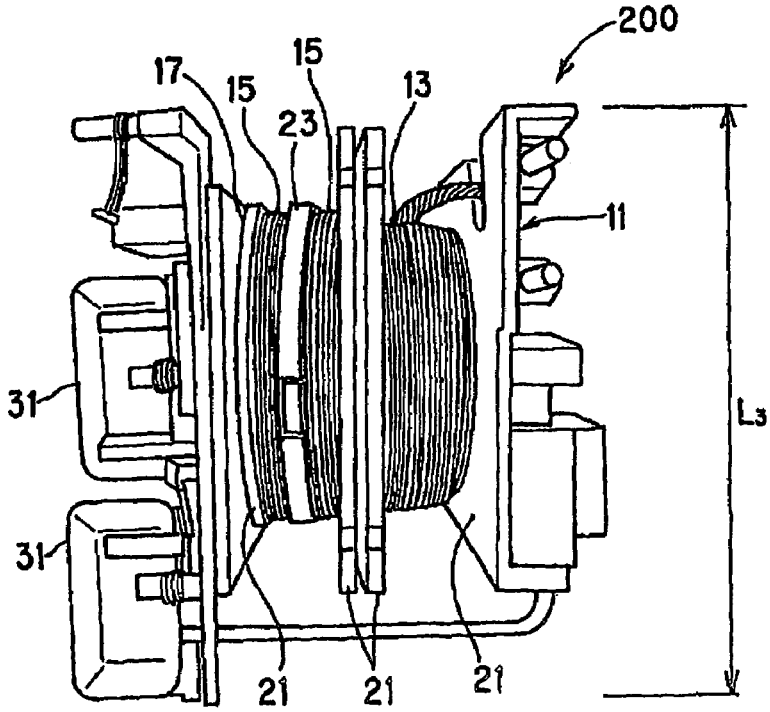

FIG. 7 shows a structural example of the transformer unit. FIG. 7(*a*) is a side view when a substrate mounting surface faces downward and FIG. 7(*b*) is a view taken along an arrow A in (a).

As shown in FIGS. 7(*a*) and 7(*b*), the width $L_1$, the height $L_2$ and the depth $L_3$ can be reduced when a capacitor 31 and a diode 33 as the high-voltage components of the transformer unit 200 are fitted to one of the side surfaces of the bobbin 11. When these values are set to fall within the range of the relation (1) so that the transformer unit 200 can be shaped substantially into a cubical shape, the occupying area of the transformer unit 200 on the substrate can be reduced when it is packaged and can contribute to the reduction of the size of the substrate. The height can be reduced, too, and the necessary capacity for fitting the substrate into a heating cooking machine, for example, can be drastically reduced. Incidentally, though this embodiment represents the structural example where the high-voltage components are fitted to the side surface of the bobbin 11, this construction is not particularly restrictive and the size of the transformer unit 200 can be further reduced when the high-voltage components are fitted onto the substrate.

Figure 8:
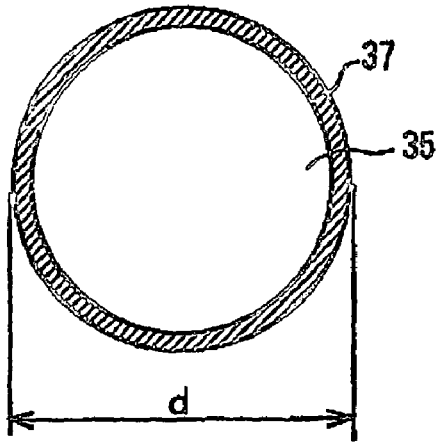
FIGS. 8(*a*) to 8(*c*) are sectional views of a wire material used for a winding of a booster transformer, specifically FIG. 8(*a*) is a sectional view of a litz wire and FIG. 8(*b*) is a sectional view f an over-coat litz wire.
Figure 8:
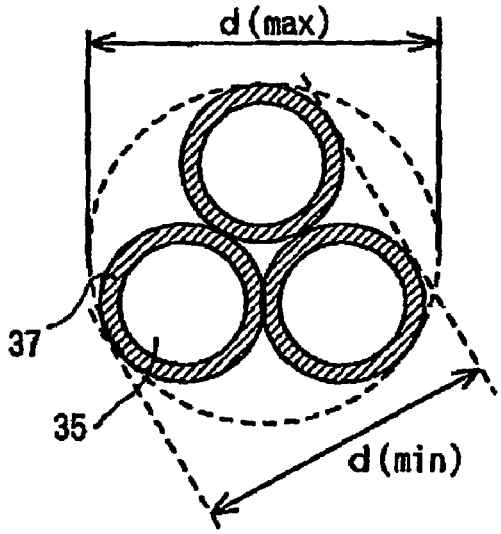
Figure 8:
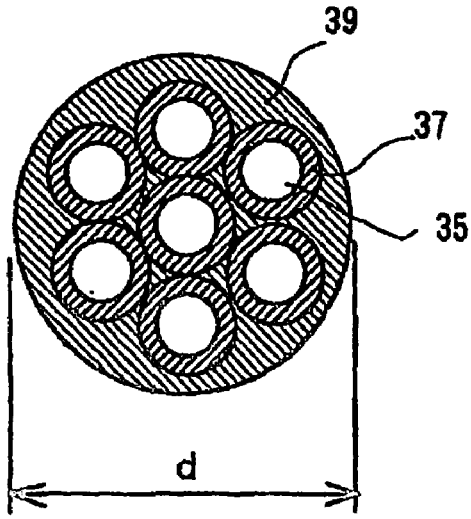
Figure 9:
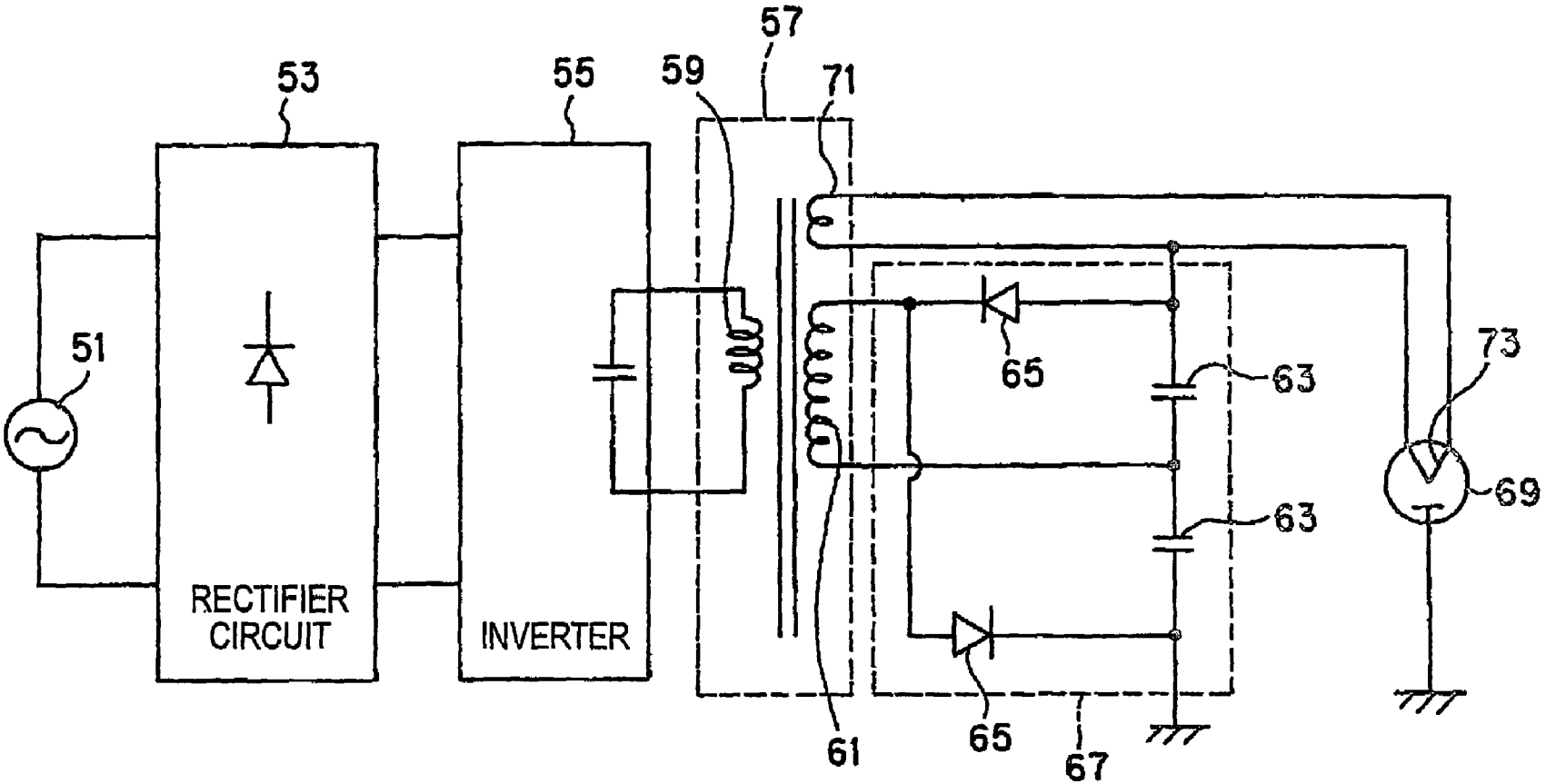
FIG. 9 is a circuit diagram of a transformer unit.
Figure 10:
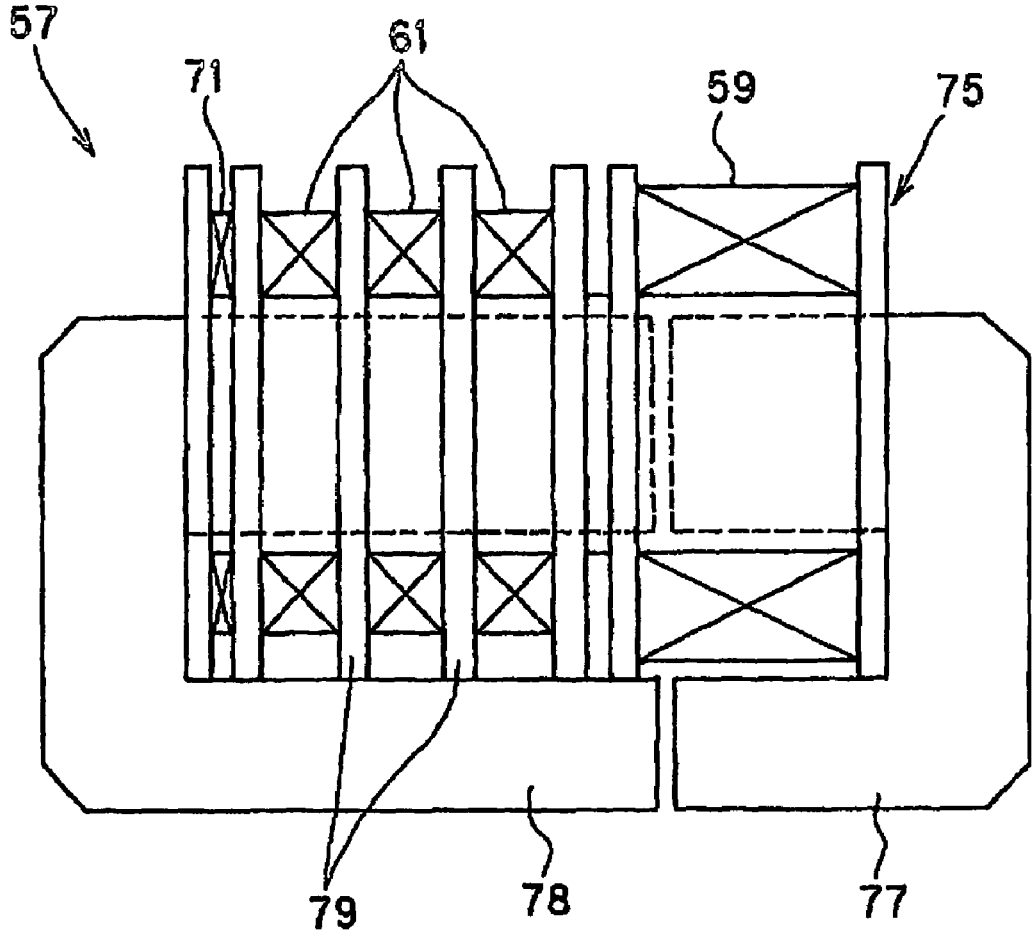
FIG. 10 is a schematic structural view of a booster transformer for driving a magnetron according to the prior art.

Examples of the wire material used as the winding of the booster transformer 100 includes a solid wire, a litz wire and an over-coat litz wire and all of them can be used appropriately. FIG. 8 shows the sectional shapes of these wires. FIG. 8(*a*) shows the section of the single wire, FIG. 8(*b*) shows the section of the litz wire and FIG. 8(*c*) shows the section of the over-coat litz wire.

An ordinary wire material excellent in the withstand voltage property is the over-coat litz wire obtained by bundling a plurality of wire materials formed by coating a core wire 35 with an insulating coating 37 such as an enamel and having a round sectional shape but this wire is expensive. On the other hand, though the litz wire is economical, it is inferior to the over-coat litz wire in the withstand voltage and durability. In the booster transformer 100 according to the invention, however, a withstand voltage design having a sufficient margin is achieved by the shape of the bobbin 11. Therefore, even though the withstand voltage of the wire material itself is low, durability does not drop. As a result, the drop of durability resulting from the occurrence of corona discharge is not invited even when the economical solid wire or litz wire is used, and the booster transformer 100 can be constituted at a low cost. In other words, the invention can sufficiently use the solid wire merely having the insulating coating 37 around the core wire 35 or the non-overcoat type litz wire formed by twisting a plurality of such solid wires without using the construction in which a bundle of litz wires is over-coated with the insulating material 39 round the outer circumference into the round sectional shape.

As to the diameter d of the litz wire, the diameter can take various values from the minimum diameter d(min) of the outer surface of the insulating coating 37 of each core wire 35 to the maximum diameter d(max) as the diameter of a circumscribed circle with the outer surface of the insulating coating 37 of each core wire 35 but in any case, the diameter is so set as to satisfy the conditions of the relations (1) and (2) already described.

As described above, according to the booster transformer and the transformer unit of the invention, the size and the cost can be reduced without scarifying the performance of the transformer and the transformer can be utilized not only as the transformer for driving the magnetron of the heating cooking machine but also as the transformers for various applications in versatile constructions without departing from the scope of the invention.

INDUSTRIAL APPLICABILITY

As explained above, in the booster transformer for driving the magnetron according to the invention, the winding area of the secondary winding is divided into two areas while interposing the partition wall and the outer diameter d of the wire material of the secondary winding and the width $t_1$ of each of the divided winding area are so set as to satisfy the relation $t_1<11d$. In consequence, it is possible to prevent the occurrence of corona discharge, to improve durability and to reduce the overall size of the booster transformer.

In the transformer unit equipped with this booster transformer, all of the width, height and depth of the transformer unit can be reduced and the transformer unit can be shaped substantially into a cubic shape. Accordingly, when the transformer unit is packaged onto the substrate, the occupying area on the substrate can be decreased and the size of the substrate can be reduced. The height can be lowered and the required packaging capacity can be reduced, too.

The invention claimed is:

1. A booster transformer for driving a magnetron, comprising:

a bobbin having a primary winding and a secondary winding wound thereon; and a core inserted into a center of said bobbin, wherein a winding area of said secondary winding is divided into two areas while interposing a partition wall, and an outer diameter d of a wire of said secondary winding, a width $t_1$ of each of the divided wiring areas and a thickness $t_2$ of said partition wall are so set as to satisfy the relation $0.8t_2<t_1<11d$.

2. A booster transformer for driving a magnetron as defined in claim 1, wherein said secondary winding is wound on said bobbin while a wire material thereof is arranged under an irregular state.

3. A booster transformer for driving a magnetron as defined in claim 1, wherein the wire material of said secondary winding is a solid wire having an insulating coating formed around a core wire or a litz wire formed by merely twisting a plurality of said solid wires.

4. A booster transformer for driving a magnetron as defined in claim 1, wherein high-voltage components constituting a voltage doubler rectifier circuit for rectifying a high frequency high voltage from said secondary winding of said booster transformer are held integrally with said bobbin.

* * * * *